United States Patent [19]

Holster

[11] Patent Number: 4,892,159

[45] Date of Patent: Jan. 9, 1990

[54] KERF-CUTTING APPARATUS AND METHOD FOR IMPROVED DRILLING RATES

[75] Inventor: Jesse L. Holster, Spring, Tex.

[73] Assignee: Exxon Production Research Company, Houston, Tex.

[21] Appl. No.: 277,166

[22] Filed: Nov. 29, 1988

[51] Int. Cl.[4] ..... E21B 7/18

[52] U.S. Cl. ..... 175/336; 175/376

[58] Field of Search ..... 175/329, 330, 336, 376, 175/377, 378; 299/60

[56] References Cited

U.S. PATENT DOCUMENTS

| | | | |
|---|---|---|---|
| 3,055,443 | 9/1962 | Edwards | 175/330 |
| 3,215,215 | 11/1965 | Kellner | 175/330 |
| 3,385,385 | 5/1968 | Kucera et al. | 175/374 |
| 3,424,255 | 1/1969 | Mori et al. | 175/60 |
| 3,424,258 | 1/1969 | Nakayama | 175/333 |
| 3,433,331 | 3/1969 | Heyberger et al. | 175/330 |
| 3,542,142 | 11/1970 | Hasiba et al. | 175/67 |
| 3,756,332 | 9/1973 | Crane | 175/364 |
| 3,838,742 | 10/1974 | Juvkam-Wold | 175/380 |
| 3,845,830 | 11/1974 | Fowler et al. | 175/404 |
| 3,924,698 | 12/1975 | Juvkam-Wold | 175/393 |
| 4,006,788 | 2/1977 | Garner | 175/330 |
| 4,174,759 | 11/1979 | Arbuckle | 175/67 |
| 4,207,954 | 6/1980 | Jerome | 175/330 |
| 4,230,194 | 10/1980 | Logan, Jr. | 175/379 |
| 4,343,371 | 8/1982 | Baker, III et al. | 175/329 |
| 4,534,427 | 8/1985 | Wang et al. | 175/67 |
| 4,760,888 | 8/1988 | Saito | 175/259 |

FOREIGN PATENT DOCUMENTS

| | | | |
|---|---|---|---|
| 197806 | of 1978 | Fed. Rep. of Germany | 175/336 |
| 73/2541 | 5/1972 | South Africa . | |
| 77/6218 | 10/1977 | South Africa . | |

*Primary Examiner*—William P. Neuder

*Attorney, Agent, or Firm*—Pamela L. Wilson

[57] ABSTRACT

An earth drilling bit that cuts concentric annular kerfs ahead of primary drilling means and thereby increases drilling rate. The bit includes a bit body having a lower end forming an annular cutter for cutting an outer annular kerf, an inner drill member positioned concentrically within the bit body having a lower end forming an annular cutter for cutting an inner annular kerf, a plurality of rotary drilling members attachedly arranged between the bit body and inner drill member positioned so lowermost cutting edges are above lowermost edges of the annular cutters of the bit body and inner drill member for removing material between the outer and inner annular kerfs, and plurality of drilling members attachedly arranged within the inner drill member positioned so lowermost cutting edges are above lowermost edges of the annular cutter of the inner drill member for removing material within the inner annular kerf.

35 Claims, 5 Drawing Sheets

KERF-CUTTING APPARATUS AND METHOD FOR IMPROVED DRILLING RATES

FIELD OF THE INVENTION

The present invention relates generally to bits used in drilling earth formations. More specifically, the present invention concerns an apparatus and method for improving drilling rates by cutting concentric annular kerfs ahead of primary drilling means.

BACKGROUND OF THE INVENTION

Modern drilling operations used to create boreholes in the earth for the production of oil, gas and geothermal energy typically employ rotary drilling techniques. In rotary drilling, a borehole is created by rotating a tubular drill string having a drill bit secured to its lower end. As drilling proceeds, additional tubular segments are added to the drill string to deepen the hole. While drilling, a pressurized fluid is continually injected into the drill string. This fluid passes into the borehole through one or more nozzles in the drill bit and returns to the surface through the annular channel between the drill string and the walls of the borehole. The drilling fluid carries the rock cuttings out of the borehole and also serves to cool and lubricate the drill bit.

One basic type of rotary rock drill is a drag bit. Some drag bits have steel or hard faced edges, but primarily they have a main body into the outer surface of which are embedded extremely hard cutting elements. These cutting elements are typically made of natural or synthetic diamonds. As the drag bit is rotated, the cutting elements scrape against the bottom and sides of the borehole to cut away rock.

Another basic type of rotary rock drill uses roller cone cutters mounted on the body of the drill bit so as to rotate as the drill bit is rotated. The angles of the cones and bearing pins on which they are mounted are aligned so that the cones essentially roll on the bottom of the hole with controlled slippage. One type of roller cone cutter is an integral body of hardened steel with teeth formed on its periphery. Another type has a steel body with a plurality of tungsten carbide or similar inserts of high hardness that protrude from the surface of the body somewhat like teeth. As the roller cone cutters roll on the bottom of the hole being drilled, the teeth or carbide inserts apply a high compressive load to the rock and fracture it. The cutting action of roller cone cutters is typically by a combination of crushing, chipping and scraping. The cuttings from a roller cone cutter are typically a mixture of moderately large chips and fine particles.

When drilling rock with a roller cone cutter, the fracture effect of loading on the teeth of the rock bed is limited due to the rock matrix surrounding the borehole. Failure of rock is prevented in a large degree by the restraint to movement offered by the surrounding rock. Thus, it appears in usual drilling operations that small cracks are created in the rock which return to the surface of the bottom of the wellbore creating chips instead of propagating deep into the rock itself. Thus, the bit tooth of the usual rock bit presses on the rock surface tending to create small cracks which propagate downward, but by virtue of the resistance to fracture offered by the surrounding rock matrix, a crack follows the path of least resistance and emerges at the surface on the bottom of the wellbore, thus creating the small chips.

U.S. Pat. No. 3,055,443 to Edwards discloses a combination drag bit and roller cone cutter which removes the lateral restraint on a core to be drilled. The drag bit component cuts a single annular kerf forming a core which is received within a hollow body member and drilled by multicone rolling cutters arranged within the hollow body member. Windows are provided in the bit body adjacent to the multicone cutters to provide an egress for chips formed by the destruction of the core. This bit design causes rapid failure of the drag cutters, however, since drilling fluid escapes through the windows and results in insufficient fluid flow to cool the drag bit component.

In the practice of the present invention, the resistance of the rock to fracture is removed or reduced by employing an improved drill bit which destroys the rock rapidly and efficiently. The drill bit of the present invention overcomes the prior art problems of rock chip removal and cutter cooling associated with cutting a single annular kerf and removing material within the kerf. Furthermore, the drill bit of the present invention cuts multiple annular kerfs which result in more rapid drilling rates than those achieved by cutting a single annular kerf.

SUMMARY OF THE INVENTION

The present invention is directed to an earth drilling bit which cuts concentric annular kerfs ahead of primary drilling means thereby increasing drilling rate. The bit has the following principal features: a bit body having a lower end forming an annular cutter; an inner drill member positioned concentrically within the bit body having a lower end forming an annular cutter; a first plurality of rotary drilling members attachedly arranged between the bit body and inner drill member positioned so lowermost cutting edges are above lowermost cutting edges of the annular cutters of the bit body and inner drill member; and a second plurality of drilling members attachedly arranged within the inner drill member positioned so lowermost cutting edges are above lowermost cutting edges of the annular cutter of the inner drill member. Upon rotation of the drill bit, the annular cutters of the drill bit body and inner drill member cut concentric annular kerfs ahead of the rotary drilling members. The rotary drilling members then fracture and remove material between and within the annular kerfs rapidly and efficiently since the material between the kerfs is no longer laterally restrained.

A preferred embodiment of the present invention is a drill bit having lower ends of the bit body and inner drill member forming annular kerf-cutting skirts having a generally saw-tooth configuration, a plurality of face plates comprising diamonds attached to cutting faces of the skirt, and defining outlet passages between adjacent skirt teeth; three spaced apart cutting wheels attachedly arranged between the bit body and inner drill member; and three spaced apart roller cone cutters attachedly arranged within the inner drill member.

BRIEF DESCRIPTION OF THE DRAWINGS

For a better understanding of the present invention, reference may be had to the drawings in which.

These drawings are not intended to in any way define the present invention, but are provided solely for the purpose of illustrating certain preferred embodiments and applications of the present invention.

DESCRIPTION OF THE PREFERRED EMBODIMENT

Figure 1:
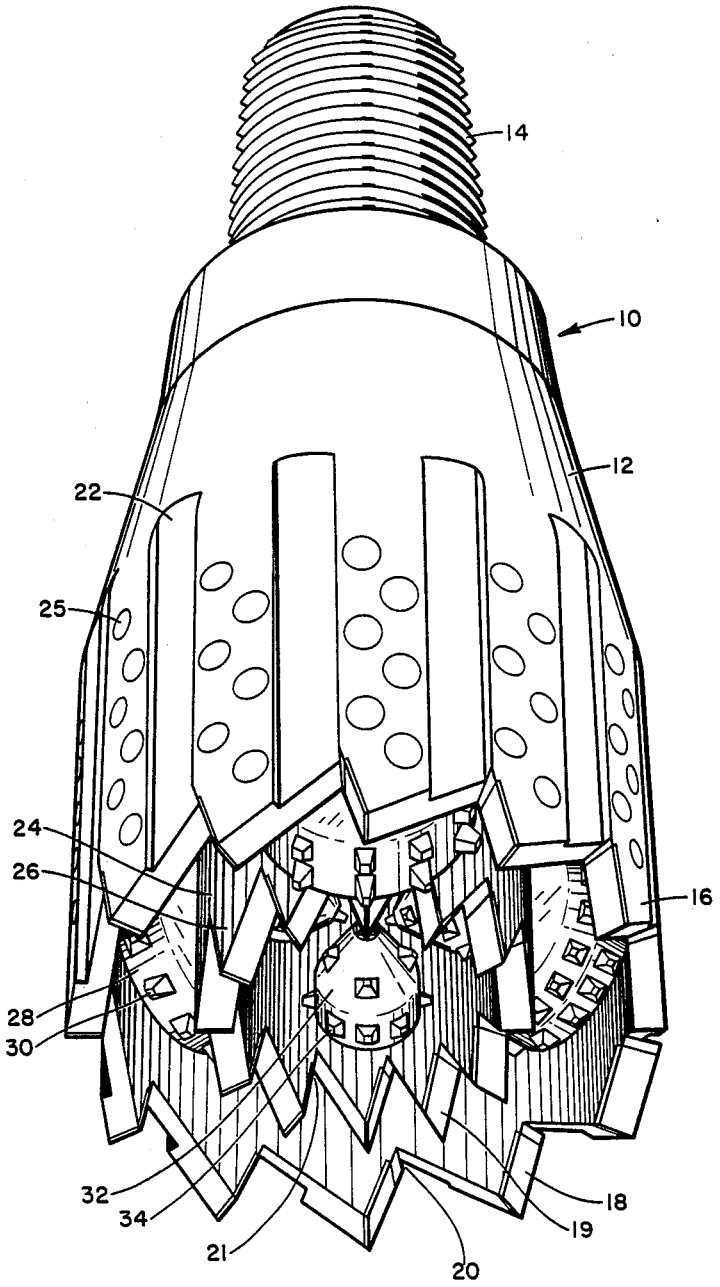
FIG. 1 is a perspective view of the improved rotary drill bit of the present invention.

Referring to FIG. 1, drill bit 10 includes: a bit body 12 provided with a lower end forming an annular cutter 16 for cutting an outer annular kerf; an inner drill member 24 positioned concentrically within bit body 12 also provided with a lower end forming an annular cutter 26 for cutting an inner annular kerf; rotary drilling members 28 attachedly arranged between bit body 12 and inner drill member 24 and positioned so that lowermost cutting edges are above lowermost cutting edges of annular cutters 16 and 26 to remove material between the outer and inner annular kerfs; and rotary drilling members 32 attachedly arranged within inner drill member 24 and positioned so that lowermost cutting edges are above lowermost cutting edges of annular cutter 26 for removing material surrounded by the inner annular kerf.

Figure 2:
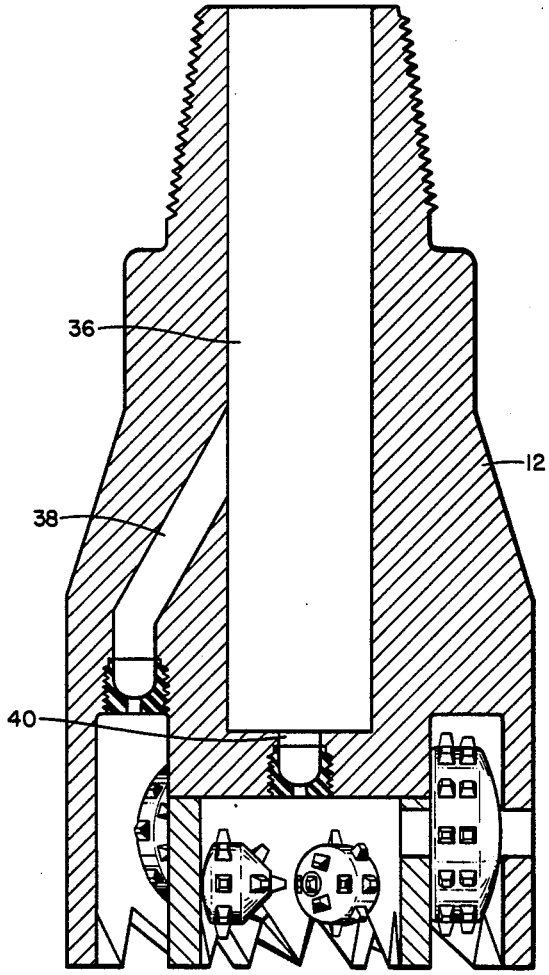
FIG. 2 is a sectional view taken along the line 2—2 of FIG. 3.
Figure 3:
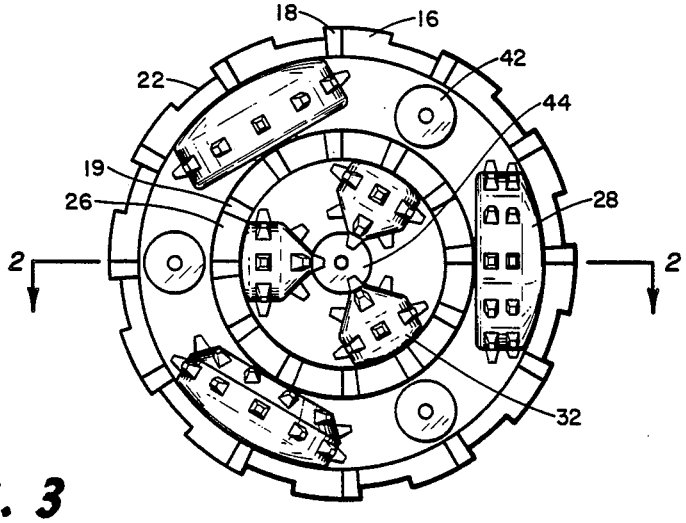
FIG. 3 is an end view of the drill bit of FIG. 1.

FIGS. 1, 2 and 3 illustrate a drill bit 10 incorporating a preferred embodiment of the present invention. Bit 10 includes a bit body 12 provided on its upper end with connecting means 14 in the form of the usual pin for the attachment to the lower end of a hollow drill string. Any suitable connecting means may be employed in this invention, however. Bit body 12 is provided on its lower end with an annular cutter 16 in the form of a kerf-cutting skirt having a generally saw-tooth configuration, a plurality of face plates 18 comprising diamonds, including either natural or synthetic, attached to cutting faces of cutter 16, and defining outlet passages 20 between adjacent skirt teeth. Bit body 12 is further provided with a plurality of spaced apart grooves or junk slots 22 extending longitudinally from cutter 16 toward the upper end of bit body 12. The combination of outlet passages 20 and spaced apart grooves 22 ensures that cuttings and drilling fluid may be adequately removed from below and around bit 10. Bit body 12 may be still further provided with gauge wear pads 25 in the conventional manner for slowing the rate of wear on a bit body made of steel or other suitable hard material. Gauge wear pads 25 may comprise tungsten carbide buttons and may be press-fit into predrilled holes on the surface of bit body 12 between junk slots 22 so that pads 25 are flush with the surface of bit body 12.

Drill bit 10 also includes an inner drill member 24 positioned concentrically within bit body 12. Inner drill member 24 is connected at its upper end to bit body 12. Connection to the bit body may be in any manner including welding, threading, or molding the bit body and inner drill member as one piece. Inner drill member 24 is provided on its lower end with an annular cutter 26 in the form of a kerf-cutting skirt having a generally saw-tooth configuration, a plurality of face plates 19 comprising diamonds, including either natural or synthetic, attached to cutting faces of cutter 26, and defining outlet passages 21 between adjacent skirt teeth.

Face plates 18 and 19 may be constructed from polycrystalline diamond compact (PDC) by cutting rectangular shapes from PDC disks such as those commercially available from General Electric or DeBeers. The face plates so constructed may be attached to cutting faces by any suitable means.

Drill bit 10 further includes three spaced apart rotary drilling members 28 in the form of cutting wheels journaled between bit body 12 and inner drill member 24 for rotation relative thereto. Other conventional attaching means such as floating sleeve friction or roller bearings may be used in place of journal bearings. Rotary drilling members 28 are provided with cutting teeth 30 comprising tungsten carbide or other suitable material and the drilling members are positioned so that lowermost cutting teeth are above the lowermost edges of the teeth of cutters 16 and 26, but yet below the uppermost edges of outlet passages 20. This positioning provides an egress adjacent to cutting teeth 30 so that cuttings and chips formed by the teeth may easily escape from around and beneath rotary drilling members 28 and be carried to the surface by drilling fluid. The spacing of cutting teeth 30 on rotary drilling members 28 may be varied in the conventional manner to minimize tracking and maximize cutting efficiency by assuring cutting over the full face of members 28. The angle between the journal axis of each rotary drilling member 28 and a radial line perpendicular to the bit longitudinal axis at the point of attachment of each rotary drilling member 28 may also be varied to minimize tracking and maximize cutting efficiency. The external contour of rotary drilling members 28 may also be varied to accommodate the angles of attachment to allow for rotation of rotary drilling members 28.

Figure 8:
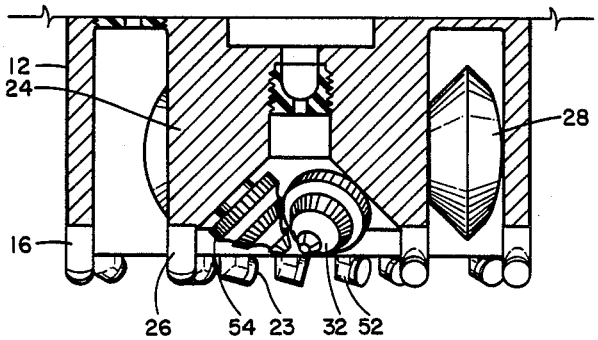
FIG. 8 is a sectional elevation view taken along the line 8—8 of FIG. 9 showing yet another embodiment of the annular cutter of the bit body and inner drill member.
Figure 9:
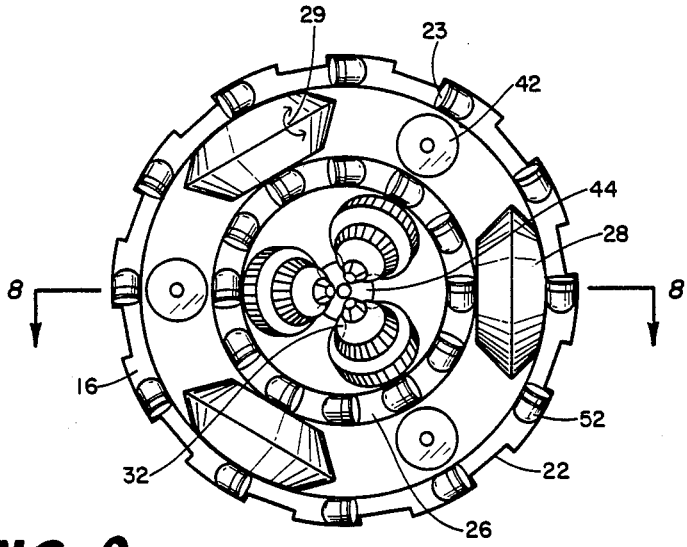
FIG. 9 is an end view of the annular cutting edges of FIG. 8 also showing other embodiments of the rotary drilling members.

Drill bit 10 still further includes three spaced apart rotary drilling members 32 in the form of roller cone cutters journaled within inner drill member 24 for rotation relative thereto. Again, other conventional attaching means may be used. Rotary drilling members 32 are provided with a plurality of cutting carbide insert teeth 34 protruding from the surface of rotary drilling members 32 and are also positioned so that lowermost cutting insert teeth are above the lowermost edges of the teeth of cutter 26, but yet below the uppermost edges of outlet passages 21. Spacing of cutting insert teeth 34 may also be varied in the conventional manner to minimize tracking and maximize cutting efficiency. Furthermore, the angle of attachment of rotary drilling members 32 may be varied in the conventional manner to minimize tracking and maximize cutting efficiency. A preferred arrangement of rotary drilling members 32 is illustrated in FIGS. 8 and 9.

Figure 4:
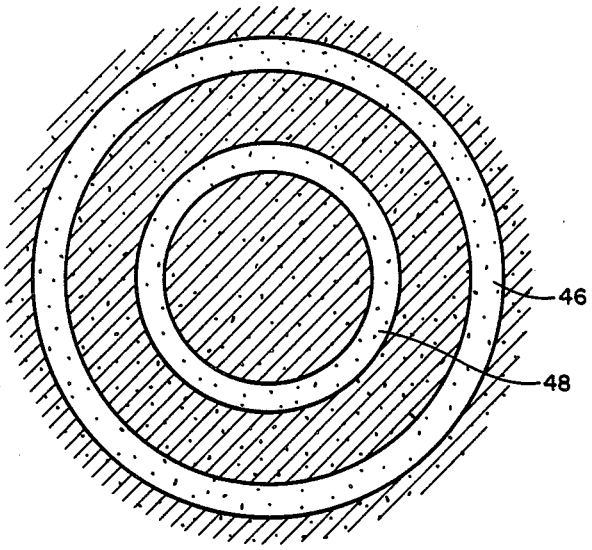
FIG. 4 is a top view of FIG. 5 taken along line 4—4 showing the inner and outer annular kerfs cut by the drill bit of the present invention.
Figure 5:
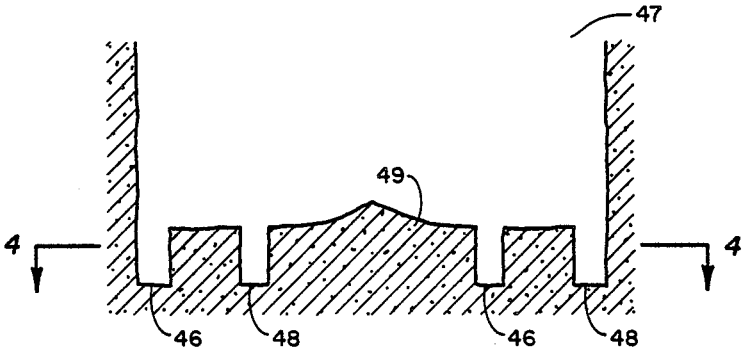
FIG. 5 is a cross sectional elevation view of the borehole cut by the bit of the present invention.

FIGS. 4 and 5 illustrate the bottom of a borehole 47 in which annular cutter 16 has cut an outer annular kerf 46 and annular cutter 26 has cut an inner annular kerf 48 positioned concentrically within the outer annular kerf 46 upon rotation of bit 10. Since the lowermost cutting edges of rotary drilling members 28 and 32 are positioned above the teeth of annular cutters 16 and 26, the annular kerfs 46 and 48 are cut into the earth material 49 ahead of the drilling members 28 and 32 thereby removing lateral restraint from material 49 between and within the annular kerfs. Rotary drilling members 28 fracture and remove material from between annular kerfs 46 and 48 and rotary drilling members 32 fracture and remove material surrounded by and within annular kerf 48 rapidly and efficiently by crushing, chipping, and scraping action of the cutting teeth 30 and 34.

Rock chips and cuttings are removed from between and beneath rotary drilling members 28 and 32 and annular cutters 16 and 26 by drilling fluid delivered through bit 10 by means of a drilling fluid conduit 36, shown in FIG. 2, which connects to the hollow drill string, not shown. Drilling fluid is delivered separately to rotary drilling members 28 by fluid passageways 38 and to rotary drilling members 32 by fluid passageway 40. As shown in FIG. 3, passageways 38 discharge drilling fluid through jet nozzles 42 located between each of rotary drilling members 28 and passageway 40 discharges drilling fluid through jet nozzle 44 centrally located between rotary drilling members 32. The drilling fluid carries cuttings and rock chips from the regions around and beneath the cutters and rotary drilling members through outlet passages 20 and 21 and around bit 10 through grooves 22.

Figure 6:
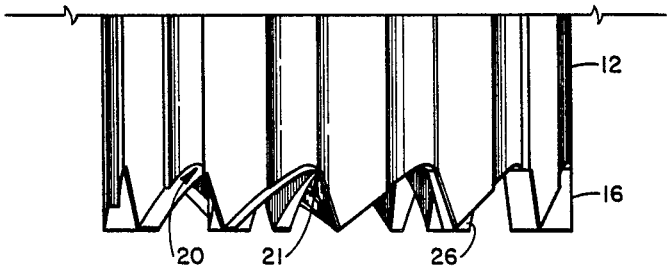
FIG. 6 is a partial elevation view of a preferred embodiment of the annular cutter of the bit body and inner drill member.

In a preferred embodiment shown in FIG. 6, outlet passages 20 and 21 are enlarged to provide a greater egress adjacent to cutting teeth 30 and 34 so that cuttings and chips may more easily escape from the regions around and beneath the cutters and rotary drilling members.

Figure 7:
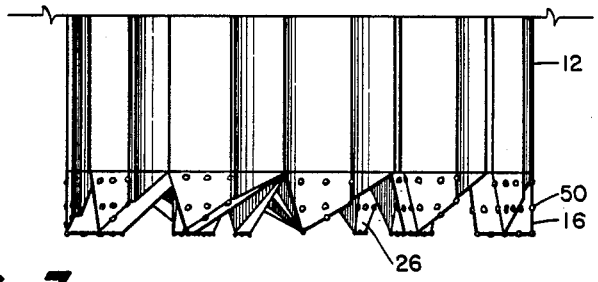
FIG. 7 is a partial elevation view of another embodiment of the annular cutter of the bit body and inner drill member.

In another embodiment of the present invention shown in FIG. 7, annular cutter 16 or 26 may form a kerf-cutting skirt having a generally saw-tooth configuration provided with abrasive resistant means 50 embedded on cutting faces of the cutter. Abrasive resistant means 50 may comprise diamonds, including either natural or synthetic, diamond-tungsten carbide matrix, carbides such as, tungsten carbide, boron carbide or silicon carbide, or any other suitable hard material.

In another embodiment shown in FIGS. 8 and 9, annular cutter 16 or 26 may comprise a plurality of studs 52 protruding from the lower end of bit body 12 or inner drill member 24 and may be provided with abrasive resistant means on cutting faces of studs 52. Again, abrasive resistant means may comprise diamonds, including either natural or synthetic, diamond-tungsten carbide matrix, carbides such as, tungsten carbide, boron carbide or silicon carbide, or any other suitable hard material. Face plates 23 comprising diamonds, including either natural or synthetic, may also be attached to cutting faces of studs 52 as shown in FIG. 8 and may be constructed from PDC disks. This embodiment of cutter 16 or 26 may be constructed by press fitting studs 52 into holes pre drilled in the lower end of bit body 12 or inner drill member 24.

In another embodiment of the present invention shown in FIG. 9, rotary drilling members 28 may comprise spaced apart cutting disks. The wedge angle 29 of the cutting disks may be varied to maximize cutting efficiency.

In yet another embodiment also shown in FIGS. 8 and 9, rotary drilling members 32 may comprise roller cone cutters provided with a plurality of abrasive resistant teeth 54 milled on the surface of the cone. The teeth may be coated with a carbide, such as tungsten carbide, boron carbide or silicon carbide.

Figure 10:
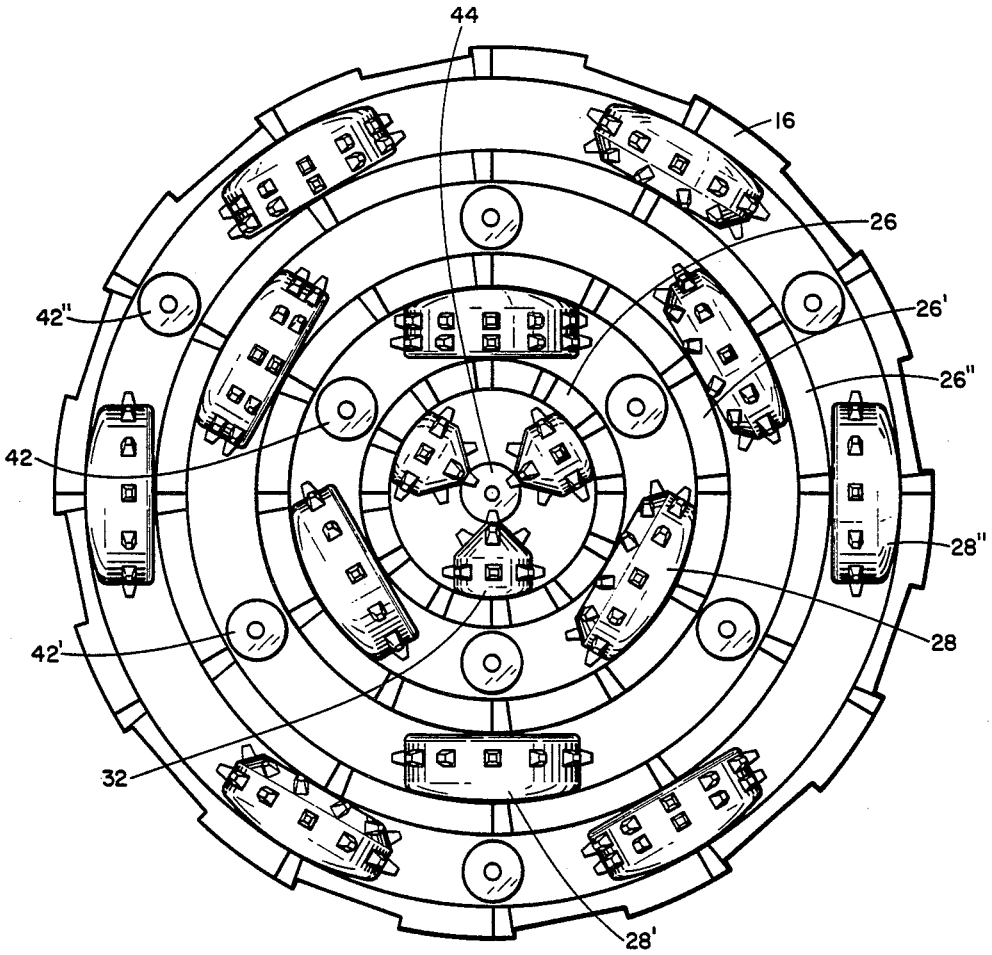
FIG. 10 is an end view of another embodiment of the Present invention showing multiple annular kerf cutters.

In still another embodiment of the invention shown in FIG. 10, a plurality of inner drill members provided on lower ends with annular cutters 26, 26′ and 26″ are positioned concentrically one within the other and within the bit body which is provided on its lower end with annular cutter 16. Each of the plurality of inner drill members is connected at its upper end to bit body 12. Rotary drilling members 28, 28′ and 28″ are attachedly arranged between each of the plurality of the inner drill members and between the bit body and the outermost inner drill member, respectively and are positioned so that lowermost cutting edges are above the lowermost cutting edges of the annular cutters of the bit body and inner drill members. Rotary drilling members 32 are attachedly arranged within the innermost inner drill member and positioned so that lowermost cutting edges are above the lowermost cutting edges of the innermost drill member annular cutter. Upon rotation of the bit, annular cutters 26, 26′, 26″, and 16 cut concentric annular kerfs ahead of rotary drilling members 32, 28, 28′, and 28″. Rotary drilling members 28, 28′ and 28″ remove material between concentric annular kerfs and rotary drilling members 32 remove material surrounded by and within the innermost annular kerf. Cuttings and rock chips are removed from between and beneath annular cutters 26, 26′, 26″ and 16 and rotary drilling members 32, 28, 28′ and 28″ by drilling fluid discharged from jet nozzles 42, 42′ and 42″ located between rotary drilling members 28, 28′ and 28″ respectively and jet nozzle 44 centrally located between rotary drilling members 32.

It is to be understood that any combination of rotary drilling members and annular cutter variations described in the above embodiments are included in the present invention. For example, this invention includes a drill bit comprising a bit body annular cutter forming a saw-tooth kerf-cutting skirt, an inner drill member annular cutter having protruding abrasive resistant studs, disk and insert type rotary drilling members and insert and milled teeth roller cone cutters.

In order to illustrate the benefits of this invention, laboratory drilling experiments were conducted using pre-kerfed rock and an oil field type bit. Cutting a single kerf ahead of the primary rock cutting tool increased drilling rate by 63%, whereas cutting two concentric kerfs, as taught by the present invention, increased drilling rate by more than a factor of 4. Depth of kerf appears to be important when single kerfs are present, but much less significant when two or more annular kerfs have been cut. It was also found that the benefits of this invention are most apparent when the roller cone bit cutting structure is well matched to the kind of rock being drilled.

In the experiments, slabs of Carthage Marble were prepared by sawing 36 in. long by 15.5 in. diameter cores into six slabs each. Using a drill press with diamond core saws, some of these slabs were cut to have a single annular kerf, some slabs were cut to have multiple annular kerfs, and other slabs were left uncut. The slabs were then stacked and cemented together to form 36 in. long test samples. The assembled test samples were then jacketed with rubber and sealed by placing metal plates at each end. The top plate had an opening to allow a bit to pass through and contact the rock. These top and bottom plates were held in contact with the rock by threaded steel rods that extended axially along the perimeter of the samples and loaded in tension, thereby compressing the individual pre-kerfed slabs together tightly. The rubber sleeve was tightly wrapped around the entire sample to seal out confining fluid.

For each of the tests conducted, the prepared rock sample was lowered into a pressure vessel along with a bit, drill stem, wellbore rotary seal, and pressure vessel cap. The cap was then tightened to seal the vessel. A drill rig was positioned over the vessel, and the drill shaft was attached to the rotary drive shaft. All kerf-drilling experiments were conducted in similar downhole environments. The wellbore pressure was maintained at 2000 psi. The rock was stressed to simulate the overburden and horizontal stresses that approximate burial of the rock at approximately 4300 ft. of depth. Overburden stress was 4350 psi while the horizontal or radial confining stress was 2900 psi. The temperature of the drilling mud was maintained between 105° F. and 110° F. All tests were conducted by loading the bit to 45,000 lbs. and 60 rpm. During drilling, the weight on the bit fluctuated plus or minus 500 lbs., while the rotary speed varied plus or minus 2 rpms from the set conditions. Flow rate was maintained at 360 gpm, plus or minus 5 gpm, producing a bit hydraulic horsepower of approximately 2.45 hydraulic horsepower per square inch.

An 8½ in. diameter tungsten carbide insert bit, Hughes J-33 Sealed Journal-Bearing Bit (IADC 537), equipped with three 13/32-in. diameter jet nozzles, yielding a total flow area of 0.389 in.$^2$ was used. The drilling fluid was a water-base mud.

The rate of penetration (ROP) was measured each second as the bit drilled into the test samples. ROP was determined by dividing the measured incremental change in penetration of the bit by a time interval of one second. The average ROP in the unkerfed rock drilled by the J-33 bit was 14.0 ft/hr. When drilling single kerfed samples the instantaneous ROP increased to more than 36 ft/hr. While drilling a double kerfed sample having two concentric rings, an instantaneous ROP of 87.5 ft/hr was achieved.

One way to analyze this data is to compare average drilling rates through the kerfed sections by first determining the average ROP through the kerfed region and then normalizing by dividing each with the average ROP in the unkerfed rock. The result for each kerfed section then represents a ratio or "ROP improvement factor" which indicates the benefit gained by kerfing the rock ahead of the bit. Since the kerfed annular rings effectively remove a portion of the bottom-hole area before the bit has to drill the remaining areas, the normalization process is completed by correcting the ROP data to account for the effective increase in weight on the bit per unit area of hole bottom. The formula applied to generate the ROP improvement factors for each kerfed slab is $$ROP \text{ Improvement Factor} = \frac{ROPk}{ROPi} \cdot \frac{Ak}{Ai}$$

where:

$ROP_k$=average ROP in the kerfed section, $ROP_i$=average ROP in unkerfed rock, $A_k$=cross-sectional area of rock remaining in kerfed borehole, and $A_i$=cross-sectional area of the entire borehole.

The ROP improvement factor for unkerfed rock is therefore 1.0. The best case for a slab with a single annular kerf had an ROP improvement factor of 1.63. Slabs having multiple kerfs had a very significant and impressive impact on ROP. Double kerfs consistently produced ROP improvement factors greater than 2.4, with one increase being as high as 4.42. In another case drilled with three concentric kerfs, the ROP improvement factor was found to be 4.81.

Thus the drill bit of the present invention will significantly improve drilling rate over unkerfed rock and even over rock having a single annular kerf.

The preferred embodiments of the present invention have been described above. It should be understood that the foregoing description is intended only to illustrate certain preferred embodiments of the invention and is not intended to define the invention in any way. Other embodiments of the invention can be employed without departing from the full scope of the invention as set forth in the appended claims.

I claim:

1. A drill bit comprising:

(a) a bit body having an upper end and a lower end, said lower end forming an annular cutter for cutting an outer annular kerf on rotation of the drill bit;

(b) an inner drill member positioned concentrically within said bit body having an upper end connected to said bit body and a lower end forming an annular cutter for cutting an inner annular kerf positioned concentrically within the outer annular kerf on rotation of the drill bit;

(c) a first plurality of rotary drilling members attachedly arranged between said bit body and inner drill member for rotation relative to said bit body and inner drill member, having lowermost cutting edges positioned above lowermost cutting edges of the annular cutter of said bit body and inner drill member to remove material between the outer and inner annular kerfs;

(d) a second plurality of rotary drilling members attachedly arranged within said inner drill member for rotation relative to said inner drill member, having lowermost cutting edges positioned above lowermost cutting edges of the annular cutter of said inner drill member to remove material surrounded by the inner annular kerf;

(e) a drilling fluid conduit disposed within said drill bit for delivering drilling fluid to said annular cutters and said first and second plurality of rotary drilling members, said conduit separately discharging fluid to said first and second plurality of rotary drilling members; and (f) means for connecting the upper ends of said bit body and drilling fluid conduit to a string of drill pipe.

2. A drill bit in accordance with claim 1 wherein said bit body defines a plurality of spaced apart grooves extending longitudinally from the annular cutter of said bit body toward the upper end of said bit body for removal of drilling fluid and cuttings from below the drill bit.

3. A drill bit in accordance with claim 1 wherein the annular cutter of said bit body comprises a kerf-cutting skirt having a generally saw-tooth configuration, abrasive resistant means on cutting faces of the skirt and defining outlet passages between adjacent skirt teeth for removal of cuttings from below the bit.

4. A drill bit in accordance with claim 3 wherein said abrasive resistant means comprises diamonds.

5. A drill bit in accordance with claim 3 wherein said abrasive resistant means comprises carbides selected from the group consisting of tungsten carbide, boron carbide and silicon carbide.

6. A drill bit in accordance with claim 3 wherein said abrasive resistant means comprises tungsten carbide.

7. A drill bit in accordance with claim 3 wherein a plurality of face plates comprising diamonds are attached to cutting faces of the skirt.

8. A drill bit in accordance with claim 1 wherein the annular cutter of said inner drill member comprises a kerf-cutting skirt having a generally saw-tooth configuration, abrasive resistant means on cutting faces of the skirt and defining outlet passages between adjacent skirt teeth for removal of cuttings from below the bit.

9. A drill bit in accordance with claim 8 wherein said abrasive resistant means comprises diamonds.

10. A drill bit in accordance with claim 8 wherein said abrasive resistant means comprises carbides selected from the group consisting of tungsten carbide, boron carbide and silicon carbide.

11. A drill bit in accordance with claim 8 wherein said abrasive resistant means comprises tungsten carbide.

12. A drill bit in accordance with claim 8 wherein a plurality of face plates comprising diamonds are attached to cutting faces of the skirt.

13. A drill bit in accordance with claim 1 wherein the annular cutter of said bit body comprises a plurality of studs protruding from said bit body having abrasive resistant means on cutting faces of the studs.

14. A drill bit in accordance with claim 13 wherein said abrasive resistant means comprises diamonds.

15. A drill bit in accordance with claim 13 wherein said abrasive resistant means comprises carbides selected from the group consisting of tungsten carbide, boron carbide and silicon carbide.

16. A drill bit in accordance with claim 13 wherein said abrasive resistant means comprises tungsten carbide.

17. A drill bit in accordance with claim 13 wherein a plurality of face plates comprising diamonds are attached to cutting faces of the studs.

18. A drill bit in accordance with claim 1 wherein the annular cutter of said inner drill member comprises a plurality of studs protruding from said inner drill member having abrasive resistant means on cutting faces of the studs.

19. A drill bit in accordance with claim 18 wherein said abrasive resistant means comprises diamonds.

20. A drill bit in accordance with claim 18 wherein said abrasive resistant means comprises carbides selected from the group consisting of tungsten carbide, boron carbide and silicon carbide.

21. A drill bit in accordance with claim 18 wherein said abrasive resistant means comprises tungsten carbide.

22. A drill bit in accordance with claim 18 wherein a plurality of face plates comprising diamonds are attached to cutting faces of the studs.

23. A drill bit in accordance with claim 1 wherein said first plurality of rotary drilling members comprises at least two spaced apart cutting wheels having abrasive resistant teeth.

24. A drill bit in accordance with claim 23 wherein said abrasive resistant teeth comprise tungsten carbide.

25. A drill bit in accordance with claim 1 wherein said first plurality of rotary drilling members comprises at least two spaced apart cutting discs.

26. A drill bit in accordance with claim 1 wherein said second plurality of rotary drilling members comprises at least two spaced apart roller cone cutters.

27. A drill bit in accordance with claim 26 wherein said roller cone cutters have a plurality of abrasive resistant insert teeth protruding from the surface of said roller cone cutters.

28. A drill bit in accordance with claim 27 wherein said abrasive resistant insert teeth comprise tungsten carbide.

29. A drill bit in accordance with claim 26 wherein said roller cone cutters have a plurality of abrasive resistant milled teeth on the surface of said roller cone cutters.

30. A drill bit in accordance with claim 29 wherein said abrasive resistant teeth are coated with carbide.

31. A drill bit in accordance with claim 1 wherein said drilling fluid conduit comprises separate passageways discharging separately above and between each of said first and second plurality of rotary drilling members through jet nozzles.

32. A drill bit comprising:

(a) a bit body having an upper end and a lower end, said lower end forming an annular kerf-cutting skirt having a generally saw-tooth configuration and abrasive resistant means on cutting faces of the skirt for cutting an outer annular kerf on rotation of the drill bit;

(b) an inner drill member positioned concentrically within said bit body having an upper end connected to said bit body and a lower end forming an annular kerf-cutting skirt having a generally saw-tooth configuration and abrasive resistant means on cutting faces of the skirt for cutting an inner annular kerf positioned concentrically within the outer annular kerf on rotation of the drill bit;

(c) at least two spaced apart cutting wheels attachedly arranged between said bit body and inner drill member for rotation relative to said bit body and inner drill member, said cutting wheels having lowermost cutting edges positioned above lowermost cutting edges of the saw-tooth skirt of said bit body and inner drill member to remove material between the outer and inner annular kerfs;

(d) at least two spaced apart roller cone cutters attachedly arranged within said inner drill member for rotation relative to said inner drill member, said roller cone cutters having a plurality of abrasive resistant teeth protruding from the surface of the roller cone cutters with lowermost cutting teeth positioned above lowermost cutting edges of the saw-tooth skirt of said inner drill member to remove material surrounded by the inner annular kerf;

(e) a drilling fluid conduit disposed within said drill bit for delivering drilling fluid to said cutting wheels, roller cone cutters, and annular kerf-cutting skirts, said conduit comprising separate passageways discharging separately above and between each of said spaced apart cutting wheels and roller cone cutters;

(f) means for connecting said drilling fluid conduit and the upper end of said bit body to a string of drill pipe.

33. A drill bit comprising:

(a) a bit body having an upper end and a lower end, said lower end forming an annular kerf-cutting skirt for cutting an outer annular kerf on rotation of the drill bit, said skirt having a generally saw-tooth configuration, a plurality of face plates comprising diamonds attached to cutting faces of the skirt, and defining outlet passages between adjacent skirt teeth for removal of cuttings from below the bit, said bit body defining spaced apart grooves extending longitudinally from the annular kerf-cutting skirt toward the upper end of said bit body for removal of cuttings and drilling fluid from below the drill bit;

(b) an inner drill member positioned concentrically within said bit body having an upper end connected to said bit body and a lower end forming an annular kerf-cutting skirt for cutting an inner annular kerf positioned concentrically within the outer annular kerf on rotation of the drill bit, said skirt having a generally saw-tooth configuration, a plurality of face plates comprising diamonds attached to cutting faces of the skirt and defining outlet passages between adjacent skirt teeth for removal of cuttings from below the bit;

(c) three spaced apart cutting wheels attachedly arranged between said bit body and inner drill member for rotation relative to said bit body and inner drill member to remove material between the outer and inner annular kerfs, said cutting wheels having cutting teeth comprising tungsten carbide with lowermost cutting teeth positioned above lowermost cutting edges of the skirt teeth and below uppermost edges of the outlet passages of said bit body;

(d) three spaced apart roller cone cutters attachedly arranged within said inner drill member for rotation relative to said inner drill member to remove material surrounded by the inner annular kerf, said roller cone cutters having a plurality of cutting carbide teeth protruding from the surface of said roller cone cutters with lowermost cutting teeth positioned above lowermost cutting edges of the skirt teeth of said inner drill member and below the uppermost edges of the outlet passages of said inner drill member;

(e) a drilling fluid conduit disposed within said drill bit for delivering drilling fluid to said cutting wheels, roller cone cutters, and annular kerf-cutting skirts, said conduit comprising separate passageways discharging separately above and between each of said spaced apart cutting wheels and roller cone cutters;

(f) means for connecting said drilling fluid conduit and the upper end of said bit body to a string of drill pipe.

34. A drill bit comprising:

(a) a bit body having an upper end and a lower end, said lower end forming an annular cutter for cutting an outer annular kerf on rotation of the drill bit;

(b) a plurality of inner drill members positioned concentrically one within the other and within said bit body, each of said inner drill members having upper ends connected to said bit body and lower ends forming annular cutters for cutting concentric annular kerfs on rotation of the drill bit;

(c) at least two spaced apart rotary drilling attachedly arranged between said bit body and the outermost of said inner drill members and between each of the plurality of said inner drill members for rotation relative to said bit body and inner drill members, said rotary drilling members having lowermost cutting edges positioned above lowermost cutting edges of the annular cutter of said bit body and inner drill members to remove material between the concentric annular kerfs;

(d) at least two spaced apart roller cone cutters attachedly arranged within the innermost of said inner drill members for rotation relative to said inner drill member, said roller cone cutters having lowermost cutting edges positioned above lowermost cutting edges of the annular cutter of the innermost of said inner drill members to remove material surrounded by the innermost concentric annular kerf;

(e) a drilling fluid conduit disposed within said drill bit for delivering drilling fluid to said rotary drilling members, roller cone cutters and annular cutters, said conduit comprising separate passageways discharging separately above and between said rotary drilling members and roller cone cutters;

(f) means for connecting said drilling fluid conduit and the upper ends of said bit body to a string of drill pipe.

35. A method for drilling a wellbore comprising rotating a drill bit which comprises:

(a) a bit body having an upper end and a lower end, said lower end forming an annular cutter;

(b) an inner drill member positioned concentrically within said bit body having an upper end connected to said bit body and a lower end forming an annular cutter;

(c) a first plurality of rotary drilling members attachedly arranged between said bit body and inner drill member for rotation relative to said bit body and inner drill member, having lowermost cutting edges positioned above lowermost cutting edges of the annular cutter of said bit body and inner drill member;

(d) a second plurality of rotary drilling members attachedly arranged within said inner drill member for rotation relative to said inner drill member, having lowermost cutting edges positioned above lowermost cutting edges of the annular cutter of said inner drill member;

(e) a drilling fluid conduit disposed within said drill bit for delivering drilling fluid to said annular cutters and said first and second plurality of rotary drilling members, said conduit comprising separate passageways discharging separately above and between said first and second plurality of rotary drilling members; and (f) means for connecting the upper ends of said bit body, inner drill member and drilling fluid conduit to a string of drill pipe, whereby upon rotation of the drill bit, the annular cutter of said bit body cuts an outer annular kerf, the annular cutter of said inner drill member cuts an inner annular kerf positioned concentrically within the outer annular kerf, said first plurality of rotary drilling members removes material between the outer and inner annular kerfs, and said second plurality of rotary drilling members removes material surrounded by the inner annular kerf.

* * * * *